US005567668A

United States Patent [19]

Oda et al.

[11] Patent Number: 5,567,668

[45] Date of Patent: Oct. 22, 1996

[54] PRESSURE- AND HEAT-SENSITIVE MULTILAYER COPYING PAPER

[75] Inventors: Kunio Oda; Nobuhiko Kitada; Akihiro Tanaka; Kazuho Fujiwara; Shinichi Matsumoto, all of Takatsuki, Japan

[73] Assignee: Naigai Carbon Ink Co., Ltd., Takatsuki, Japan

[21] Appl. No.: 338,506

[22] PCT Filed: Feb. 18, 1994

[86] PCT No.: PCT/JP94/00247

§ 371 Date: Dec. 21, 1994

§ 102(e) Date: Dec. 21, 1994

[87] PCT Pub. No.: WO94/19198

PCT Pub. Date: Sep. 1, 1994

[30] Foreign Application Priority Data

Feb. 24, 1993 [JP] Japan ..... 5-035238

[51] Int. Cl.[6] ..... B41M 5/34

[52] U.S. Cl. ..... 503/204; 503/200; 503/215; 503/226

[58] Field of Search ..... 427/152; 503/200, 503/204, 226, 208, 209, 215, 218, 221

[56] References Cited

U.S. PATENT DOCUMENTS 5,153,168 10/1992 Uhlemayr et al. ..... 503/206

FOREIGN PATENT DOCUMENTS

0501112A1 9/1992 European Pat. Off. ..... 503/226

OTHER PUBLICATIONS

Xerox Disclosure Journal, Xerographic Carbonless Paper, David J. Sanders and Edward Anczurowski, vol. 13, No. 6, Nov./Dec. 1988, pp. 341–343.

*Primary Examiner*—B. Hamilton Hess
*Attorney, Agent, or Firm*—Jones, Tullar & Cooper, P.C.

[57] ABSTRACT

This invention provides a pressure- and heat-sensitive multilayer copying paper useful as a recording material for various types of recording machines, such as a portable terminal. A pressure- and heat-sensitive multilayer copying paper comprises: an upper paper member composed of: a substrate sheet; a layer provided on a front surface of the substrate sheet comprising a organic compound and an acidic organic compound; a layer provided on a back surface of the substrate sheet comprising a organic compound, microcapsules encapsulating the organic compound and a thermomeltable material; and an overcoated protective layer placed on the layer provided on a back surface of the substrate sheet; and a lower paper member: a substrate sheet; a layer provided on a front surface of the substrate sheet comprising at least one acidic organic compound which forms color in case that it reacts with the organic compound.

26 Claims, 1 Drawing Sheet

PRESSURE- AND HEAT-SENSITIVE MULTILAYER COPYING PAPER

FIELD OF THE INVENTION

The present invention relates to pressure- and heat-sensitive multilayer copying paper.

BACKGROUND OF THE INVENTION

A colorless heat-sensitive transfer recording paper having pressure-sensitivity composed of a substrate sheet, a heat-sensitive recording layer provided on a front surface of the substrate sheet, and a layer provided on a back surface of the substrate sheet consisting of a microcapsuled electron donative colorless color-former, an electron acceptive developer which develops with the color-former, the solid color-former and developer and waxes is known to the art (Japanese Patent Kokai Publication No. 168690/1985). However, in the recording papers of this class, since the layer provided on a back surface of the substrate sheet contains both a color-former and a developer, even if weak handling pressure is applied to the material, the microcapsule may easily rupture, and pollution due to color development may occur. Furthermore, since a number of compositions have to be provided onto the same substrate sheet, the amount of coating becomes relatively large, susceptibility to pressure and heat is remarkably reduced, and good recording and copy typing may not be obtained.

To overcome these problems, a pressure- and heat-sensitive multilayer copying paper comprising a combination of: an upper paper member composed of a substrate, a heat-sensitive layer provided on a front surface of the substrate, and a transfer layer provided on a back surface of the substrate comprising a colorless color-former, a microcapsuled color-former and a thermomeltable material; and a lower paper member having an image receiving layer thereon (Japanese Kokai Patent Publication No. 90232/1987) is proposed. For using the pressure- and heat-sensitive multilayer copying paper, the upper paper member is stacked on the lower paper member, and heat is applied onto a surface thereof by the use of, for example, a thermal head, and thereby, thermal printing may be obtained on the heat-sensitive layer provided on a surface of the upper paper member, as well as a thermomeltable material of the pressure- and heat-sensitive transfer layer is melted and transferred to the lower paper due to the thus applied heat energy. The thermomeltable material co-melts with a developer provided on a front surface of the lower paper member to form heat duplicated print. When no pressure is applied, only heat duplicated print is formed, but when pressure is applied simultaneously or independently, a microcapsule provided on the back surface is broken due to the applied pressure, and a color-former encapsulated is transferred to a front surface of the lower paper member to form pressure print. The pressure- and heat-sensitive multilayer copying paper of this class is suitable for use in a portable terminal printer and the like. However, preferred clear and deep print may not be provided, because a front surface of the lower paper member is apt to be polluted by a slight pressure which is applied to the paper during handling or transporting.

The present invention overcomes these problems in the pressure- and heat-sensitive multilayer copying paper noted above. As a result, an object of the present invention achieved by placing an overcoated protective layer comprising a UV curable resin over the pressure- and heat-sensitive transfer layer comprising a color-former, a microcapsuled color-former and a thermomeltable material.

SUMMARY OF THE INVENTION

The present invention provides a pressure- and heat-sensitive multilayer copying paper comprising:

an upper paper member composed of: a substrate sheet; a layer provided on a front surface of the substrate sheet comprising a colorless electron donative color-forming organic compound (herein, it may be referred to as "a color-former") and an acidic organic compound (herein, it may be referred to as "a developer") which develops said compound in case that heat is applied to the layer for melting It; a layer provided on a back surface of the substrate sheet comprising a colorless electron donative color-forming organic compound, a microcapsule encapsulating the colorless electron donative color-forming organic compound and a thermomeltable material; and an overcoated protective layer placed over the layer provided on a back surface of the substrate sheet; and a lower paper member having a surface flatness of not less than 80 sec composed of: a substrate sheet; a layer provided on a front surface of the substrate sheet comprising at least one acidic organic compound which forms color in case that it reacts with the colorless electron donative color-forming organic compound.

DETAILED DESCRIPTION

Figure 1:
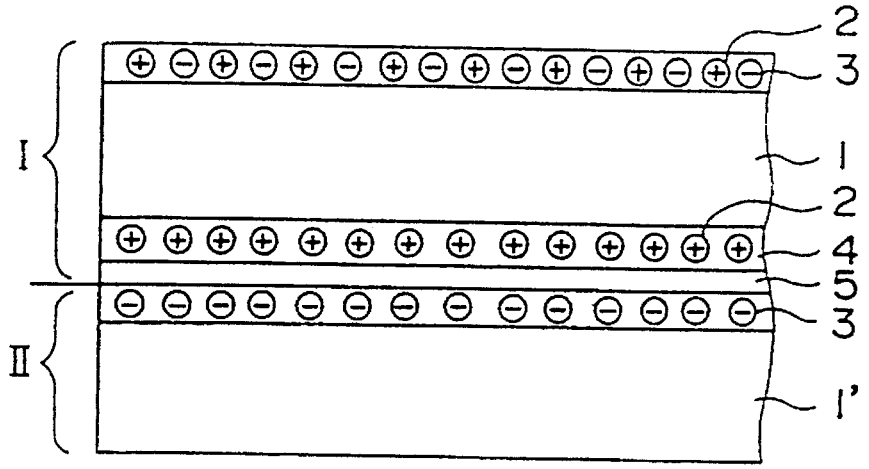
FIG. 1 is a cross sectional view which illustrates one embodiment of the present pressure- and heat-sensitive multilayer copying paper for 2P.

A color-former employed In the present pressure- and heat-sensitive multilayer copying paper may be those generally employed in a heat-sensitive paper and a pressure-sensitive paper, and includes leuco-dyes such as triphenylmethanes, triphenylmethane phthalides, fluorans, phenothiazines, indolylphthalides, Leuco Auramines, Rhodamine Lactams, triazenes and spiropyranes, specifically, includes Crystal Violet Lactone, Malachite Green Lactone, 3 -diethylamino-7-methylfluorane, 3-diethylamino-6-methyl-7-chlorofluorane, 3-diethylamino-7-dibenzylaminofluorane, 3 -diethylamino-7-anilinofluorane, 3-(N-methylanilino)-7-anilinofluorane, 3-(N-methylanilino)-7-anilinofluorane, 3 -diethylamino-7-(m-trifluromethylanilino)fluorane, 3 -diethylamino-6-methyl-7-anilinofluorane, 3 -(N-methylcyclohexylamino)-6-methyl-7-anilinofluorane, 3 -pyrrolidino-6-methyl-7-anilinofluorane, 3-piperidino-6 -methyl-7-anilinofluorane, 3-(N-methyl-p-toluidino)-6 -methyl-7-anilinofluorane and benzo-β-naphthospiropyrane. These color-formers are encapsulated into microcapsules used for the purpose of pressure-sensitivity, and is dispersed directly during use for the purpose of heat-sensitivity.

A developer included in front surface layers of the present upper paper member and lower paper member may be those generally employed In a heat-sensitive paper and a pressure-sensitive paper, and includes, for example, montmorillonite, Attapulgite, bentonite, clay, kaoline, 4 -t-butylphenol, 4-phenylphenol, 2,2-bis(p-hydroxyphenyl)propane, 2,2-bis(p-hydroxyphenyl)butane, a condensate of 4-t-butylphenol and formaldehyde, α-naphthol, β-naphthol, metal salts of salicylic acid derivatives such as a zinc salt of 5-phenyl salicylic acid, a zinc salt of 5 -t-amylsalicylic acid, a zinc salt of 3-methyl-5 -phenylsalicylic acid, a zinc salt of 3,3-di-α-methylbenzylsalicylic acid, a zinc salt of 3-methyl-5 -phenylsalicylic acid, a zinc salt of a condensate of salicylic acid and formaldehyde. These developers may be employed alone or in combination. It is particularly preferred to employ more than two developers in combination, when they are included in a surface layer of the lower paper member. Preferred combination thereof include a combination of a phenolic compound, for example, 2,2-bis(p-hydroxyphenyl)propane with a zinc salt of a salicylic acid derivative, particularly, zinc 3,3-di-α-methylbenzylsalicylate.

A sensitizer may be included in a surface layer of the upper paper member (a heat-sensitive layer). Examples of the sensitizer include amides such as stearic amide, palmitic amide, oleic amide, lauric amide, ethylenebisstearoamide and methylolstearoamide. These are generally added as an aqueous dispersion.

A microcapsule provided onto a back surface of the upper paper member contains a non-volatile liquid solution or dispersion of the color-former as a core agent. Examples of the non-volatile liquids include, for example, alkyl naphthalenic, chlorinated paraffinic, diarylethanic, alkyldiphenillic, aromatic esteric and aliphatic esteric solvents. As a process for making the micro capsule, a coacervation process, an interfacial polymerization process, a In-situ polymerization process and the like are known to the art. Any of these processes may be employed depending upon the applications of the present invention. The coacervation process is described in, for example, U.S. Pat. Nos. 2,800,457, 2,800,458 and 3,687,865. The interfacial polymerization process is described in, for example, U.S. Pat. Nos. 3,429,827, 3,577,515 and 3,886,085. The In-situ polymerization process is described in, for example, U.S. Pat. Nos. 3,726,804 and 3,796,669. The microcapsules obtained according to the above described methods are powdered by using a conventional method such as spray drying, before use. Since the resulting microcapsule includes a color-former, a pressure-sensitive duplicating property may be provided by the use of the microcapsule. A color-former is employed as a form encapsulated into the microcapsule for the purpose of providing pressure-sensitivity, and it is employed as a form directly dispersed for the purpose of providing heat-sensitivity. A color-former included in the microcapsules may be the same or different from those that are not microcapsuled, but it is preferred that both are the same. Further, it is preferred that a weight ratio of the microcapsuled color-former and those does not microcapsuled has a range from 1:1 to 10:1.

A thermomeltable material employed in the present invention is a waxy material having a melting point of from 30° to 110° C. Examples of this material include, but does not limited to, carnauba wax, montan wax, ouricury wax, candelilla wax, coconut wax, paraffin wax, microcrystalline wax, Hoechst wax (such as OP and O), Bareco wax (such as WB wax), NPS wax, rice wax, low molecular weight polyethylene wax, stearic acid, palmitic acid, myristic acid, a fatty acid amide (such as stearylamide) and a ketone wax (such as stearon).

As used herein a "waxy material" refers to a material which melts into liquid form having low viscosity upon heating and sets again to a crystalline solid state upon cooling. The wording is not limited to only an academic definition which is an ester of a higher fatty acid and a higher alcohol.

A material which makes up an overcoated protective layer of the present invention is an ink comprising a UV curable resin which dries and cures by an action of photoenergy. Such an ink generally comprises a photoadditionpolymerizable monomer, prepolymer and polymer, a photopolymerization initiator, a sensitizer, an expansible pigment, and typically include, but is not limited to, the following.

Acrylates of polyols: A monomer and prepolymer included is a single substance or a mixture of an ester or a copolymer compound of a polyol with a ethylenically unsaturated acid. The unsaturated acid primarily includes acrylic acid, methacrylic acid and itaconic acid. Examples of these include a composition comprising a variety of glycols or trimethylol propane; ethylenic unsaturated monomers comprised of a diacrylate and polyacrylate of acrylic acid or methacrylic acid; a film forming composition comprised of a mixture of an unsaturated polyester resin, a conjugated dry oil, an epoxy resin, an urea resin and the like; and a photopolymerization initiator or a sensitizer such as benzoin ether and decylamine: or a composition comprising an acrylate of pentaerithritol; an allylsulfonamide-formaldehyde resin; and a halogenic photopolymerization initiator.

Acrylate derivatives of polyester resins: This group comprises an acryloid derivative having such a structure obtained by introducing an acryloyl group into an oil, a modified alkyd resin and a modified polyester resin, and then urethanizing them. For example, a composition comprising a reaction product of dry fatty oil, glycidyl (meth)acrylate and polyisocyanate, and a benzoin ether: or a reaction product of an acrylate of epoxylated soybean oil, methyl isocyanate and toluene diisocyanate; a reaction product of trimethylolpropane, an alkyd comprised of tall oil fatty acid and adipic acid, toluene diisocyanate, and 2-hydroxyethyl acrylate.

Epoxy acrylates: This group comprises an esterified compound of an epoxy compound with acrylic acid, methacrylic acid and itaconic acid and derivatives thereof. This is a relatively wide range group of prepolymer and polymer of from liquid to resin. As typically shown in an acrylate of an epoxy resin of bisphenol A-epichlorohydrin, an acrylate of this class has excellent photocuring property, and forms a remarkably hard film having heat and solvent resistance. Typical examples include a composition comprising a reaction product of bisphenol A-epichlorohydrin of epoxy with acrylic acid or methacrylic acid and ketone sensitizer; a mixed composition comprising a product of a halogen containing epoxy compound-acrylic acid, a polyol acrylate and a photo polymerization initiator.

Drying oils and modified alkyds: This group mainly comprises a polymerization reaction product of oils having conjugated double bonds. Since this class primarily comprises a raw material of a conventional solvent based ink, this class has advantages in cost and printing ability. For example, a composition to which is added a sulfur containing sensitizer such as mercaptan and thiophenol to a varnish obtained by cooking tung oil and a solvent soluble resin (such as ketone resin) at a temperature of not more than 260° C., or a varnish composition obtained by mixing or cooking α-mono- or α-poly-halogenketone, dehydrated castor oil, a modified alkyd resin, an optional isocyanate modified compound thereof., tung oil and a hard resin, may be included.

The vernish composition may be employed itself as a UV curable ink, but it may further include an organic or inorganic pigment, an extender pigment and a metal powder and the like, and may include an adjuvant for a conventional ink such as vaseline, a matting agent, a slipping agent and an anti-foaming agent, and may include an adjuvant peculiar to the UV curing system including a chain transfer agent such as acryl monomer and prepolymer.

A process for making the UV curable ink may be the same as those employed for conventional printing ink, except that care should be exercised for preventing partially reacting the ink composition under high temperature caused by partially high shear strength generated in the kneading procedure. That is, a three-roll mill, a sand mill, a KD mill and a ball mill may be employed for kneading and dispersing each ingredient to prepare an ink.

A substrate sheet employed includes a polyester film, polycarbonate film, a base paper. It is preferred that such a substrate sheet has a weight of from 15 to 40 g/m$^2$. If the weight of the substrate sheet is less than 15 g/m$^2$, workability at coating process becomes extremely worse, and if the weight is more than 40 g/m$^2$, the heat transfer ability from the thermal head of the thermal printer becomes worse, and developing density of the resulting transfer print becomes insufficient.

In an process for making the upper paper member (I), a heat-sensitive layer is provided on a front surface of the substrate sheet (1), as shown in FIG. 1. A heat-sensitive solution is provided by combining liquid A prepared by mixing, grinding and finely dispersing color-former (2) into water-soluble binder (for example, an aqueous solution of polyvinyl alcohol, polyacrylamide or starch) by the use of the ball mill or the sand grinder, with liquid B prepared by grinding and finely dispersing developer (3) into water-soluble binder. When excellent sensitivity is desired, it is preferred that a sensitizer be added, and the sensitizer may optionally be mixed and finely dispersed into any one of the solutions described above. The heat-sensitive solution prepared by combining liquid A and B is then applied onto a front surface of the substrate sheet (1) in an amount of from 2 to 8 g/m$^2$, and dried to form a heat-sensitive layer. A thermomeltable material (4), a color-forming fine powder (2) and a microcapsuled color-former (2') which is powdered according to the above mentioned method are mixed and uniformly dispersed by heating and melting, and the resulting mixture was applied on a back surface of the substrate sheet (1) in a coating amount of from 2 to 5 g/m$^2$ to form a pressure- and heat-sensitive transfer layer. A combining ratio of the color-former and the thermomeltable material is not particularly limited, but 3 to 15 parts by weight of the color-former based on 100 parts by weight of the thermomeltable material is preferred. A UV curable ink is further coated over the resulting pressure- and heat-sensitive transfer layer in a coating amount of from 0.2 to 1.0 g/m$^2$ according to a lithograph, letterpress, screen, gravure and flexographic printing, and then, UV light is irradiated on the resulting ink layer to form the overcoated protective layer (5).

The lower paper member employed in the present invention may be prepared by finely dispersing the developer (3) into an aqueous solution of latex (such as SBR latex) and/or a water-soluble binder (such as starch and polyvinyl alcohol) by the use of ball mill and sand grinder, applying the resulting mixture on a front surface of the substrate sheet (1'), and drying it.

Figure 2:
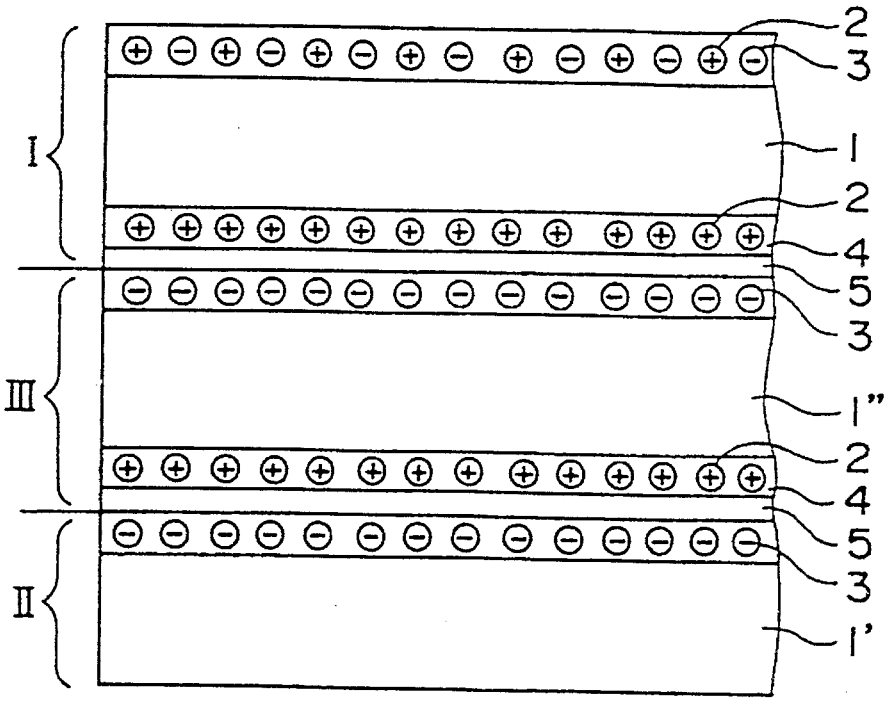
FIG. 2 is a cross sectional view which illustrates one embodiment of the present pressure- and heat-sensitive multilayer copying paper for 3P.

When a multiple sheet recording is required, as shown in FIG. 2, a middle paper member (III) composed of a substrate sheet (1"), a layer comprising a developer (3) providing a front surface of the substrate sheet, a layer comprising a color-former (2), a microcapsuled color-former (2') and thermomeltable material (4), and an overcoated protective layer (5) placed over the layer provided on a back surface of the substrate sheet may be inserted between the upper paper member (I) and the lower paper member (II).

EXAMPLES

The following examples further describe the present invention and should not be interpreted as limiting the scope of the invention.

Preparative Example 1

| Ingredients | Parts by Weight |
|---|---|
| 3,3-bis(p-dimethylaminophenyl)-6-dimethylaminophthalide | 5.0 |
| Benzoyl Leuco Methylene Blue | 2.5 |
| paraffine wax | 45.0 |
| Armide HT | 15.0 |
| Hoechst Wax OP | 8.0 |
| candelilla wax | 7.0 |
| a powder of microcapsuled 3,3-bis-(dimethylaminophenyl)-6-dimethylamino-phthalide | 17.5 |

The above ingredients were melted and dispersed at a temperature of from 120° to 130° C., and then, the resulting dispersant was hot-melt coated on a back surface of a heat-sensitive recording paper at a temperature of from 70° to 80° C. in a coating amount of from 2.0 to 5.0 g/m$^2$. Over the resulting layer, a UV curable ink prepared in the following formulation was coated according to offset printing in a coating amount of 0.8 g/m$^2$, the ink layer was UV irradiated to be cured, and resulted in an upper paper member for forming a blue color.

| Ingredients | Parts by Weight |
|---|---|
| pentaerythritol triacrylate | 5.0 |
| hydroquinone monomethyl ether | 0.01 |
| ketone resin | 25.0 |
| benzophenone | 10.0 |
| p-dimethylamino acetophenone | 2.0 |

Preparative Example 2

| Ingredients | Parts by Weight |
|---|---|
| 2-(N-3'-trifluoromethylphenyl)amino)-6-diethylamino fluorane paraffine wax 115° | 50.0 |
| Armide HT | 5.0 |
| carnauba wax | 15.0 |
| a powder of microcapsuled 2-(N-(3'-trifluoromethylphenyl)-amino)-6-diethyl-amino fluorane | 23.0 |

A mixture of the above ingredients was coated on a back surface of a heat-sensitive recording paper in essentially the same manner as described in Example 1. Over the resulting layer, a UV curable ink prepared in the following formulation was coated according to offset printing in a coating amount of 0.8 g/m$^2$, the ink layer was UV irradiated to cure, and resulted in an upper paper member for forming a black color.

| Ingredients | Parts by Weight |
|---|---|
| a reaction product of hexamethylene diisocyanate and hydroxypropyl acrylate | 84.0 |
| butanediol glycidyl ether diacrylate | 10.0 |
| p-dimethylamino benzaldehyde | 3.0 |
| benzophenone | 3.0 |
| phenotiazine | 0.15 |

Preparative Example 3

| Ingredients | Parts by Weight |
|---|---|
| 2,2-bis(P-hydroxyphenyl) propane | 60.0 |
| zinc salt of 3,3-di-α-methylbenzyl-salicylic acid | 15.0 |
| calcium carbonate | 120.0 |
| zinc oxide | 20.0 |
| polyvinyl alcohol | 15.0 |
| SBR latex | 10.0 |
| water | 200.0 |

The above ingredients are uniformly mixed in a sand grinder to prepare a coating liquid having an average particle size of 3 μm, and the resulting liquid was coated in an amount of from 2.0 to 6.0 g/m$^2$ solids, dried and calendared to obtain the lower paper member having a surface smoothness of not less than 80 sec.

Example 1

An upper paper member prepared in Preparative Example 1 and a lower paper member prepared in Preparative Example 3 are combined, and printed by the use of a portable terminal N6994-44B (made by Nippon Denki K.K.) to obtain a blue printed image. The results obtained are shown in Table 1.

Example 2

An upper paper member prepared in Preparative Example 2 and a lower paper member prepared in Preparative Example 3 are combined, and printed by the use of a portable terminal N6994-44B (made by Nippon Denki K.K.) to obtain black printed image. The results obtained are shown in Table 1.

Comparative Example 1

Printing was conducted to obtain a blue printed image in essentially the same manner as described in Example 1, except that an upper paper member that does not have the overcoated protective layer was used. The results obtained are shown in Table 1.

Comparative Example 2

Printing was conducted to obtain black printed image in essentially the same manner as described in Example 2, except that an upper paper member that does not have the overcoated protective layer is used. The results obtained are shown in Table 1.

TABLE 1

| | Ex. 1 | Ex. 2 | C. Ex. 1 | C. Ex. 2 |
|---|---|---|---|---|
| density of color | A | A | A | B |
| clarity of printing | A | A | B | B |
| degree of pollution | A | A | C | C |

Criteria for evaluation:
A: Excellent
B: Good
C: Poor, problems may be occur upon using.

The results described above shows that the present invention provides a printed image having an excellent density of color and a decreased degree of pollution.

We claim:

1. A pressure- and heat-sensitive multilayer copying paper, comprising:

an upper paper member composed of: a substrate sheet having a front surface and a back surface; a layer provided on the front surface of the substrate sheet comprising a colorless electron donative color-forming organic compound and an acidic organic compound which develops said organic compound when heat is applied to said layer for melting it; a layer provided on the back surface of the substrate sheet comprising a colorless electron donative color-forming organic compound, pressure-sensitive microcapsules encapsulating the colorless electron donative color-forming organic compound and a thermomeltable material; and an overcoated protective layer placed over the layer provided on the back surface of the substrate sheet, said protective layer including a UV curable resin; and a lower paper member having a surface flatness of not less than 80 sec composed of: a substrate sheet having a front surface and a back surface; a layer provided on the front surface of the substrate sheet comprising at least one acidic organic compound which forms color when it reacts with the colorless electron donative color-forming organic compound.

2. The pressure- and heat-sensitive multilayer copying paper according to claim 1, comprising a middle paper member inserted between the upper paper member and the lower paper member, wherein the middle paper member is composed of: a substrate having a front surface and a back surface; a layer provided on the front surface of the substrate sheet comprising a developer; a layer provided on the back surface of the substrate comprising a color-former, pressure-sensitive microcapsules encapsulating the color-former and a thermomeltable material; and an overcoated protective layer placed over the layer provided on the back surface of the substrate sheet, said protective layer including a UV curable resin.

3. The pressure- and heat-sensitive multilayer copying paper according to claim 2, wherein the electron donative color-forming organic compound is selected from the group consisting of triphenylmethanes, triphenylmethane phthalides, fluorans, phenothiazines, indolylphthalides, Leuco Auramines, Rhodamine Lactams, triazenes and spiropyranes.

4. The pressure- and heat-sensitive multilayer copying paper according to claim 2, wherein the electron donative color-forming organic compound is selected from the group consisting of Crystal Violet Lactone, Malachite Green Lactone, 3-diethylamino-7 -methylfluorane, 3-diethylamino-6-methyl-7-chlorofluorane, 3 -diethylamino-7-dibenzylaminofluorane, 3-diethylamino-7 -anilinofluorane, 3-(N-methylanilino)-7-anilinofluorane, 3 -(N-methylanilino)-7-anilinofluorane, 3-diethylamino-7-(m-trifluromethylanilino)fluorane, 3-diethylamino-6-methyl-7-anilinofluorane, 3-(N-methylcyclohexylamino)-6-methyl-7-anilinofluorane, 3-pyrrolidino-6-methyl-7-anilinofluorane, 3-piperidino-6-methyl-7-anilinofluorane,3-(N-methyl-p-toluidino)-6 -methyl-7-anilinofluorane and benzo-β-naphthospiropyrane.

5. The pressure- and heat-sensitive multilayer copying paper according to claim 2, wherein the acidic organic compound is selected from the group consisting of montmorillonite, Attapulgite, bentonite, clay, kaoline, 4-t-butylphenol, 4-phenylphenol, 2,2-bis(p-hydroxyphenyl)propane, 2,2-bis(p-hydroxyphenyl)butane, a condensate of 4-t-butylphenol and formaldehyde, α-naphthol, β-naphthol, a zinc salt of 5-phenyl salicylic acid, a zinc salt of 5-t-amylsalicylic acid, a zinc salt of 3-methyl-5-phenylsalicylic acid, a zinc salt of 3,3-di-α-methylbenzylsalicylic acid, a zinc salt of 3-methyl-5-phenylsalicylic acid, a zinc salt of a condensate of salicylic acid and formaldehyde.

6. The pressure- and heat-sensitive multilayer copying paper according to claim 2 further comprising a sensitizer in the layer comprising a colorless electron donative color-forming organic compound and an acidic organic compound which develops said compound in case that heat is applied to the layer for melting it.

7. The pressure- and heat-sensitive multilayer copying paper according to claim 2, wherein the sensitizer is selected from the group consisting of stearic amide, palmitic amide, oleic amide, lauric amide, ethylenebisstearoamide and methylolstearoamide.

8. The pressure- and heat-sensitive multilayer copying paper according to claim 2, wherein the thermomeltable material is a waxy material having a melting point of from 30° to 110° C.

9. The pressure- and heat-sensitive multilayer copying paper according to claim 2, wherein the thermomeltable material is selected from the group consisting of carnauba wax, montan wax, ouricury wax, candelilla wax, coconut wax, paraffin wax, microcrystalline wax, Hoechst wax, Bareco wax, NPS wax, rice wax, low molecular weight polyethylene wax, stearic acid, palmitic acid, myristic acid, a fatty acid amide and a ketone wax.

10. The pressure- and heat-sensitive multilayer copying paper according to claim 2, wherein the overcoated protective layer consists of an ink comprising a UV curable resin which drys and cures by the action of photoenergy.

11. The pressure- and heat-sensitive multilayer copying paper according to claim 2, wherein the overcoated protective layer consists of a UV curable resin which is selected from the group consisting of polyol acrylates, polyester resin acrylate, epoxy acrylates, drying oil, modified alkyds, and acrylic monomers and prepolymers.

12. The pressure- and heat-sensitive multilayer copying paper according to claim 2, wherein each substrate sheet has a weight of 15 to 40 g/m$^2$.

13. The pressure- and heat-sensitive multilayer copying paper according to claim 2, wherein each substrate sheet is selected from the group consisting of a polyester film, a polycarbonate film and a base paper.

14. The pressure- and heat-sensitive multilayer copying paper according to claim 2, wherein a coating amount of the overcoated protective layer is in the range of from 0.3 to 1.5 g/m$^2$.

15. The pressure- and heat-sensitive multilayer copying paper according to claim 1, wherein the electron donative color-forming organic compound is selected from the group consisting of triphenylmethanes, triphenylmethane phthalides, fluorans, phenothiazines, indolylphthalides, Leuco Auramines, Rhodamine Lactams, triazenes and spiropyranes.

16. The pressure- and heat-sensitive multilayer copying paper according to claim 1, wherein the electron donative color-forming organic compound is selected from the group consisting of Crystal Violet Lactone, Malachite Green Lactone, 3-diethylamino-7-methylfluorane, 3-diethylamino-6-methyl-7-chlorofluorane, 3-diethylamino-7 -dibenzylaminofluorane, 3-diethylamino-7-anilinofluorane, 3 -(N-methylanilino)-7-anilinofluorane, 3-(N-methylanilino)-7 -anilinofluorane, 3-diethylamino-7-(m-trifluromethylanilino)fluorane, 3-diethylamino-6-methyl-7-anilinofluorane, 3-(N-methylcyclohexylamino)-6-methyl-7-anilinofluorane, 3-pyrrolidino-6-methyl-7-anilinofluorane, 3-piperidino-6-methyl-7-anilinofluorane, 3-(N-methyl-p-toluidino)-6-methyl-7-anilinofluorane and benzo-β-naphthospiropyrane.

17. The pressure- and heat-sensitive multilayer copying paper according to claim 1, wherein the acidic organic compound is selected from the group consisting of montmorillonite, Attapulgite, bentonite, clay, kaolins, 4-t-butylphenol, 4-phenylphenol, 2,2-bis(p-hydroxyphenyl)propane, 2,2-bis(p-hydroxyphenyl)butane, a condensate of 4-t-butylphenol and formaldehyde, α-naphthol, β-naphthol, a zinc salt of 5-phenyl salicylic acid, a zinc salt of 5-t-amylsalicylic acid, a zinc salt of 3-methyl-5 -phenylsalicylic acid, a zinc salt of 3,3-di-α-methylbenzylsalicylic acid, a zinc salt of 5-methyl-5 -phenylsalicylic acid, a zinc salt of a condensate of salicylic acid and formaldehyde.

18. The pressure- and heat-sensitive multilayer copying paper according to claim 1 further comprising a sensitizer in the layer comprising a colorless electron donative color-forming organic compound and an acidic organic compound which develops said compound in case that heat is applied to the layer for melting it.

19. The pressure- and heat-sensitive multilayer copying paper according to claim 1, wherein the sensitizer is selected from the group consisting of stearic amide, palmitic amide, oleic amide, lauric amide, ethylenebisstearoamide and methylolstearoamide.

20. The pressure- and heat-sensitive multilayer copying paper according to claim 1, wherein the thermomeltable material is a waxy material having a melting point of from 30° to 110° C.

21. The pressure- and heat-sensitive multilayer copying paper according to claim 1, wherein the thermomeltable material is selected from the group consisting of carnauba wax, montan wax, ouricury wax, candelilla wax, coconut wax, paraffin wax, microcrystalline wax, Hoechst wax, Bareco wax, NPS wax, rice wax, low molecular weight polyethylene wax, stearic acid, palmitic acid, myristic acid, a fatty acid amide and a ketone wax.

22. The pressure- and heat-sensitive multilayer copying paper according to claim 1, wherein the overcoated protective layer consists of an ink comprising a UV curable resin which drys and cures by the action of photoenergy.

23. The pressure- and heat-sensitive multilayer copying paper according to claim 1, wherein the overcoated protective layer consists of a UV curable resin which is selected from the group consisting of polyol acrylates, polyester resin acrylate, epoxy acrylates, drying oil, modified alkyds, and acrylic monomers and prepolymers.

24. The pressure- and heat-sensitive multilayer copying paper according to claim 1, wherein each substrate sheet has a weight of 15 to 40 g/m$^2$.

25. The pressure- and heat-sensitive multilayer copying paper according to claim 1, wherein each substrate sheet is selected from the group consisting of a polyester film, a polycarbonate film and a base paper.

26. The pressure- and heat-sensitive multilayer copying paper according to claim 1, wherein a coating amount of the overcoated protective layer is in the range of from 0.3 to 1.5 $g/m^2$.

* * * * *